US006688382B2

(12) United States Patent
Hargreaves

(10) Patent No.: US 6,688,382 B2
(45) Date of Patent: Feb. 10, 2004

(54) HEAT EXCHANGER TUBE

(75) Inventor: Colin Hargreaves, Huddersfield (GB)

(73) Assignee: Emerson & Renwick Limited (GB)

( * ) Notice: Subject to any disclaimer, the term of this patent is extended or adjusted under 35 U.S.C. 154(b) by 269 days.

(21) Appl. No.: 10/054,720

(22) Filed: Jan. 22, 2002

(65) Prior Publication Data

US 2002/0096317 A1 Jul. 25, 2002

(30) Foreign Application Priority Data

Jan. 23, 2001 (GB) ..... 0101697

(51) Int. Cl.[7] ..... F28F 1/00

(52) U.S. Cl. ..... 165/177; 165/906; 29/890.053; 138/158; 138/163

(58) Field of Search ..... 165/177, 906; 138/156, 158, 163, 164; 29/890.053

(56) References Cited

U.S. PATENT DOCUMENTS 4,222,372 A * 9/1980 Bogatzki ..... 165/177
5,186,251 A * 2/1993 Joshi ..... 165/906
5,704,423 A * 1/1998 Letrange ..... 165/177
5,765,634 A * 6/1998 Martins ..... 165/177
6,000,461 A * 12/1999 Ross et al. ..... 165/177
6,129,147 A * 10/2000 Dumetz et al. ..... 165/177
6,209,202 B1 * 4/2001 Rhodes et al. ..... 165/177
6,325,141 B2 * 12/2001 Yamauchi et al. ..... 165/177

FOREIGN PATENT DOCUMENTS

EP 0632245 * 1/1995 ..... 165/177
GB 651724 * 4/1951 ..... 165/177
JP 6123571 * 5/1994 ..... 165/177

* cited by examiner

*Primary Examiner*—Christopher Atkinson
(74) *Attorney, Agent, or Firm*—Andrus, Sceales, Starke & Sawall

(57) ABSTRACT

A flat, heat exchanger tube formed by rolling metal strip to fold inwardly the lateral edge regions of the strip to provide a tube having parallel, spaced, generally planar upper and lower walls, one of said lateral edge regions being bent to define a longitudinally extending partition wall extending within the tube towards said lower wall, said partition wall including first and second longitudinally extending regions disposed at an angle to one another so as to provide in one face of the partition wall a longitudinally extending recess receiving the free edge portion of the other of said lateral edge regions of the strip.

7 Claims, 2 Drawing Sheets

HEAT EXCHANGER TUBE

This invention relates to tubes and their manufacture, particularly flat tubes primarily intended for use in heat exchangers.

Flat heat exchanger tubes are often used in heat exchangers for use in automotive vehicles, to carry a first fluid, a second fluid being maintained in heat exchange relationship with the exterior of the tube so that heat is transferred between the first and second fluids.

It is known to manufacture flat heat exchanger tubes by a cold-rolling process from coated aluminium strip, the coating providing a "brazing" medium for sealing and securing abutting walls of the tube, and sometimes also for securing the tube to other components of the heat exchanger matrix when the heat exchanger is first manufactured.

Flat heat exchange tubes are, in lateral cross-section, relatively wide and shallow having planar, parallel, upper and lower walls interconnected by integral curved side walls. It is known to form such a tube by rolling elongate aluminium strip to raise and bend inwardly the opposite lateral edge regions of the strip to form the upper wall of the tube. The lateral edge regions engage one another at the longitudinally extending mid-line of the upper wall, and it is known from, for example, European patent 0302232, to bend the free edges of the lateral edge regions inwardly so as to lie within the tube and to define a partition within the tube extending between the upper and lower walls of the tube.

In accordance with the present invention there is provided a flat heat exchanger tube formed by rolling metal strip to fold inwardly the lateral edge regions of the strip to provide a tube having parallel, spaced, generally planar upper and lower walls, one of said lateral edge regions being bent to define a longitudinally extending partition wall extending within the tube towards said lower wall, said partition wall including first and second longitudinally extending regions disposed at an angle to one another so as to provide in one face of the partition wall a longitudinally extending recess receiving the free edge portion of the other of said lateral edge regions of the strip.

Preferably said partition wall contacts the inner surface of said lower wall and said free edge portion of said other of said lateral edge regions of the strip terminates within said recess of the partition wall.

Preferably said first region of said partition wall extends inwardly of the tube from said upper wall generally at right angles to said upper wall, said second region commences at the inner edge of tile first region and extends at an oblique angle to said first region, and, said partition wall includes a third region integral with said second region and commencing at the edge of the second region remote from the first region, said third region extending from said second region to contact the inner surface of the lower wall and lying parallel to said first region but in a plane spaced from the plane of the first region.

Conveniently the angle and extent of said second region, relative to said first and third regions, is such that said third region plane is spaced from said first region plane by the thickness of the strip material.

Desirably, the partition wall includes a fourth region commencing at the edge of the third region remote from the second region, said fourth region being a region of the strip bent through 180°, and thus lying in facial contact with the face of the partition wall remote from the face of the partition wall engaged by said free edge portion of said other of said lateral edge regions of the strip.

Alternatively said second region extends at right angles to said first region, and conveniently said third region terminates in an integral fourth region extending at right angles to said third region and ill facial contact with the lower wall of the tube.

Alternatively said first region of said partition wall extends inwardly from said upper wall of the tube at an acute angle to said upper wall, and said second region extends at an obtuse angle to said first region so as to contact the inner surface of said lower wall of the tube generally opposite the root of said first region at the upper wall.

One example of the invention is illustrated in the accompanying drawings wherein.

Figure 1:
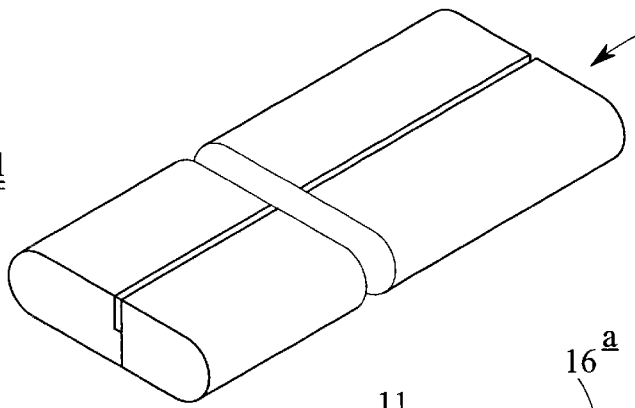
FIG. 1 is a diagrammatic perspective view of a flat, heat exchanger tube.
Figure 2:
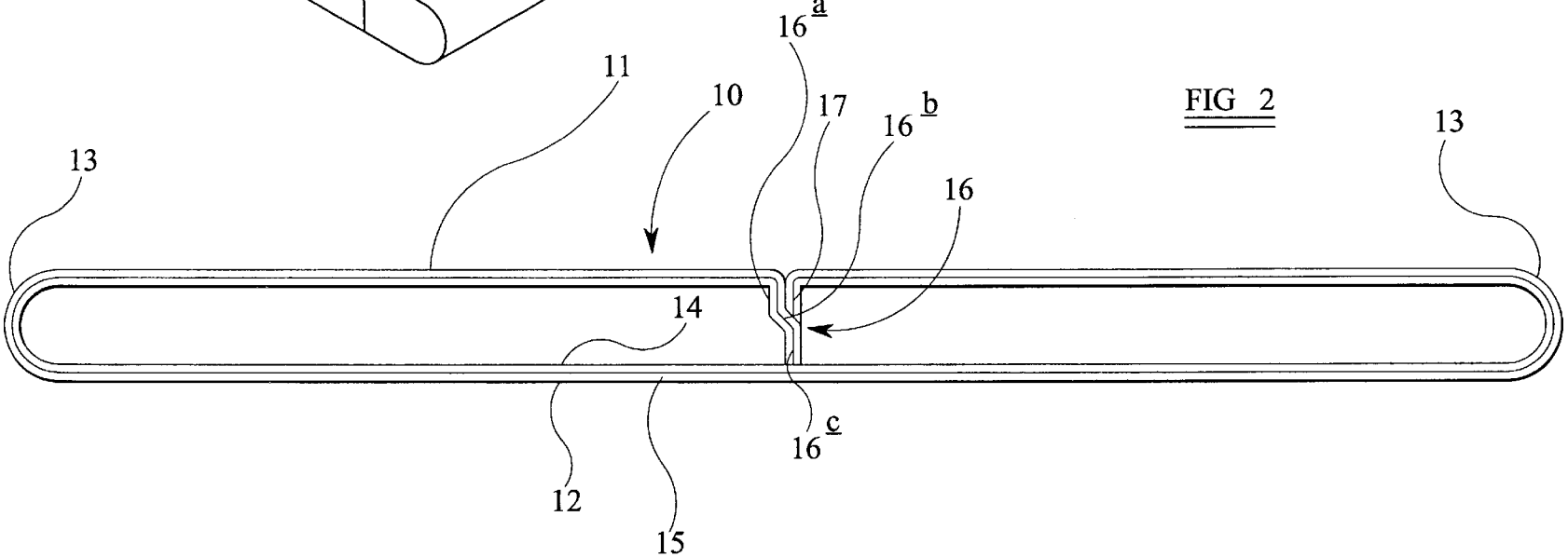
FIG. 2 is a transverse cross-sectional view, to an enlarged scale, of the tube of FIG. 1.

Referring first to FIGS. 1 and 2 of the accompanying drawings the heat exchanger tube is formed by a cold-rolling process from aluminium strip. The aluminium strip is supplied from the manufacturer in coil form and is fed to the inlet station of the cold-rolling mill or line from a substantially conventional de-reeler. The strip material is aluminium strip clad on one face with a "brazing" alloy. Such strip is readily available from companies such as Alcoa Limited and Finspong Limited. The nature of the strip and the cladding of "brazing" alloy is not relevant to the invention. It is sufficient to recognise that the "brazing" alloy cladding is not shed during the cold-rolling process, and is an alloy which melts at a lower temperature than the base aluminium strip so that during the manufacture of the heat exchanger the temperature of the components can be raised to an extent such that the alloy melts and flows to braze components together, without the aluminium base material melting.

For convenience, throughout this description, it will be assumed that the cold-rolling process initially raises the lateral edge regions of the strip and then folds them inwardly. Bearing this in mind, the strip is passed through the cold-rolling mill with the cladding layer of brazing alloy lowermost so that as the lateral edge regions of the strip are raised and formed inwardly to define the upper wall 11 of the tube 10 the cladding layer is outermost, and the inner surface of the tube is the surface of the aluminium base layer.

As is apparent from FIG. 1 the flat strip is rolled to raise the lateral edge regions and to fold them inwardly so that the strip forms a tube which can be considered to be flat, wide, and relatively shallow. The tube 10 has all upper wall 11, and a lower wall 12, the walls 11, 12 being parallel, being spaced apart, and both being generally planar. The upper and lower walls 11, 12 are interconnected by integral side walls 13 which are part-circular in transverse cross-section. As can be seen in FIG. 1 the aluminium base layer 14 of the strip is internal to the tube, and the cladding of "brazing" alloy 15 is external.

As is also apparent from FIGS. 1 and 2 the lateral edge regions of the strip which form the upper wall 11 abut along the longitudinal mid-line of the upper wall 11. Moreover, the left-hand lateral edge of the strip (with reference to the cross-sectional view of the tube in FIG. 2) extends beyond the mid-line of the upper wall 11, and is directed downwardly, within the tube, to the inner surface of the lower wall 12 to define a partition wall 16 within the tube.

The partition wall 16 is of course integral with the upper wall 11, and as is apparent from FIG. 2 includes a first region 16*a* extending inwardly of the tube from the upper wall 11 and at right angles to the upper wall 11. Integral with the lower edge of the first region 16*a* is a second region 16*b* inclined at an obtuse angle to the first region 16*a*. The angle is not critical, but conveniently is of the order of 135°. At its lower edge the second region 16*b* has integral therewith the commencement of a third region 16*c* of the partition wall 16, the region 16*c* extending parallel to the region 16*a* and, at its free edge, abutting the inner surface of the lower wall 12. The angle and the extent of the second region 16*b* of the partition wall is such that the plane of the third region 16*c* is spaced from an equivalent plane of the first region 16*a* by approximately the thickness of the strip material. As it is the left-hand lateral edge region of the strip which defines the partition wall 16 it will be recognised that the cladding layer of the region of the strip which defines the partition wall 16 is facing to the right in FIG. 2. Moreover, the displacement of the second region relative to the first and third regions is such that the plane of the third region is spaced to the right of the plane of the first region.

For the avoidance of doubt, the partition wall 16 extends through the full length of the tube 10 and the formation, and shaping, of the partition wall 16 is achieved by the cold-rolling process. The nature of the cold-rolling process is not of particular relevance to the invention, and the manner in which a strip is converted, in a series of stages, by consecutive roll stands of a cold-rolling mill, into a closed tube, will be well understood by those familiar with cold-rolling.

It will be recognised that the shaping of the partition wall 16 defines a recess in the right-hand face of the partition wall 16. As can be seen in FIG. 2, the edge portion of the right-hand lateral edge region of the strip is also bent downwardly to lie within the interior of the tube, but the in turned portion 17 of the right-hand lateral edge region of the strip is shorter than the partition wall 16, and terminates well short of the lower wall 12 of the tube. In fact, the in-turned portion 17 is seated within the recess of the right-hand face of the partition wall 16, and terminates at the shoulder defined by the second region 16*b* of the partition wall. It will also be recognized that the cladding 15 is the left-hand face of the portion 17 and thus the cladding of the portion 17 abuts the cladding of the first region 16*a* of the partition wall 16.

The tube 10, which is formed as a continuous length, is cut into predetermined lengths at the exit of the cold-rolling mill, by any convenient cutting mechanism, for example a "flying" shear. Conveniently the cut lengths of tube are not heated at this stage to cause brazing, and instead the tubes are assembled with "fin" material, and other components of the heat exchanger, to define a heat exchanger matrix which is then heated to cause the cladding of the strip material to flow and thus braze the various components of the heat exchanger together. During his process the cladding of the partition wall 16 and the portion 17 flows so that the mid-line join in the upper wall 11 is sealed by brazing alloys the partition 17 and region 16*a* are brazed together and moreover the free edge of the partition wall is brazed to the inner surface of the lower wall 12 of the tube.

Figure 3:
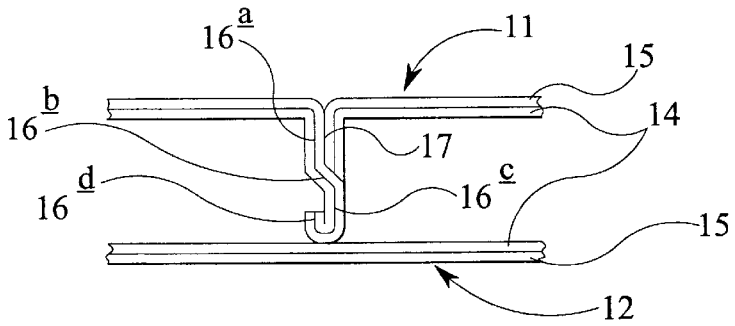
FIG. 3 is an enlarged view of part of the tube of FIGS. 1 and 2 illustrating a modification thereof, and, FIGS. 4, 5, 6, and, 7 are views similar to FIG. 3, to a reduced scale, illustrating four further alternative constructions.

FIG. 3 illustrates a modification of the arrangement illustrated in FIGS. 1 and 2 in which the portion of the strip which forms the partition wall 16 is somewhat longer, and the edge portion of the third region 16*c* of the partition wall is turned back on itself (to the left in FIG. 3) to double the thickness of the partition wall 16 adjacent the lower wall 13 of the tube. In effect the fourth region 16*d* of the partition wall, defined by bending the free edge of the partition wall through 180°, ensures that the thickness of the lower region of the partition wall matches the thickness of the partition wall where the portion 17 is brazed to the first region 16*a* of the wall. Thus the portion 17 terminates at the top of the "knees" defined by the second region 16*b* of the wall 16 and the upwardly extending fourth region 16*d* of the wall terminates beneath the "knee". It will be understood that by bending the strip material to the left (as in FIG. 3) to define the fourth region 16*d*, the cladding layer 15 lies at the outside of the bend and thus contacts the inner surface of the aluminium base of the wall 12, thus enhancing the bonding of the partition wall to the lower wall of the tube when brazing takes place.

Figure 4:
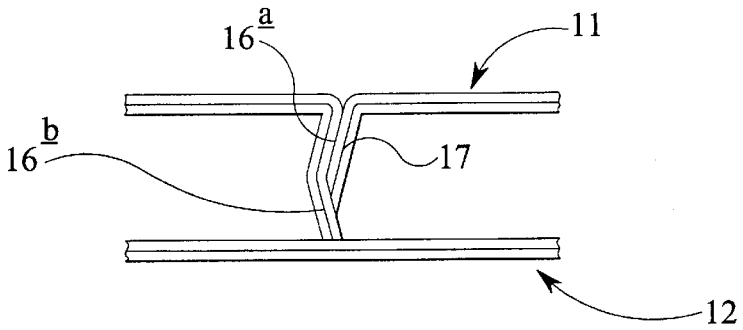

FIG. 4 illustrates a simplification of the partition wall structure. In the simplified construction the first region 16*a* of the partition wall 16 extends inwardly from the upper wall 11 at an acute angle, the region 16*a* having been bent relative to the wall 11 through more than 90. The region 16*a* extends approximately half the depth of the tube, between the walls 11, 12, and the remainder of the depth of the tube is occupied by the second region 16*b* of the partition wall. The region 16*b* is bent in the opposite direction relative to the region 16*a* so that the free edge of the region 16*b* contacts the wall 12 substantially opposite the point at which the region 16*a* merges with the upper wall 11. In essence therefore the angle subtended between the region 16*a* and the region 16*b* is double the angle subtended between the region 16*a* and the associated part of the upper wall 11. Similarly the portion 17, which lies in facial contact with the right-hand face of the region 16*a* lies at an obtuse angle to the associated region of the wall 11, the angle subtended between the portion 17 and the wall 11 being the compliment of the angle subtended between the first region 16*a* and the wall 11. Again therefore it can be seen that the portion 17 is received within the recess defined between the first and second regions of the partition wall.

Figure 5:
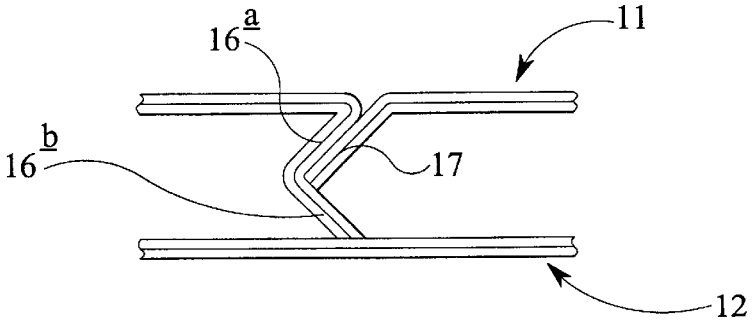

FIG. 5 illustrates a modification of the arrangement shown in FIG. 4 in which the angle between the first region 16*a* and its associated part of the wall 11 is more acute, and thus the angle subtended between the regions 16*a*, 16*b* is reduced closer to a right angle. The angle of the portion 17 is adjusted accordingly. While the recess in the partition wall 16 of the FIG. 5 arrangement is deeper, and thus provides a greater locking action supporting the portion 17 against inward displacement, the greater bend radius between the wall 11 and the first region 16*a* of the partition wall 16 generates a larger gap in the upper wall 11 along the mid-line of the wall 11 than is the case with the less tight bend radius of FIG. 4. The larger gap may prove problematic if capillary action draws too much of the brazing alloy, when molten, to fill the gap, and thus starves the interface of the portion 17 and the region 16*a*. It will be recognised therefore that there is a balance to be achieved between the size of the gap produced, and the depth of the recess, and therefore the efficiency of the mechanical "locking" of the portion 17 within the recess. In many respects the arrangement of FIGS. 2 and 3 is preferable in this regard since the bend radius is minimised; but there is nevertheless a good locking action where the free edge of the portion 17 seats on the "knee" defined by the second region 16*b* of the partition wall. Moreover the arrangement of FIGS. 2 and 3 is believed to be strong in use, the partition wall being strong in compression (normal to the plane of the tube) and resistant to lateral deformation as could occur as a result of pressure differential between the passages on opposite sides respectively of the wall. The provision of the region 16*d* of the wall ensures that the tube cross-section is effectively symmetrical thus facilitating the assembly of the tube ends into corresponding apertures punched in the walls of the associated header tanks and the like without the need to orient the tube in a single rotational position relative to the aperture.

In each of the examples illustrated in FIGS. 2 to 5 of the drawings it can be seen that the free edge of the portion 17 is chamfered at an angle corresponding to the angle of the region 16*b* which it abuts. The chamfer of the edge of the portion 17 is formed during the cold rolling process in one of the early stands of the rolling mill.

Figure 6:
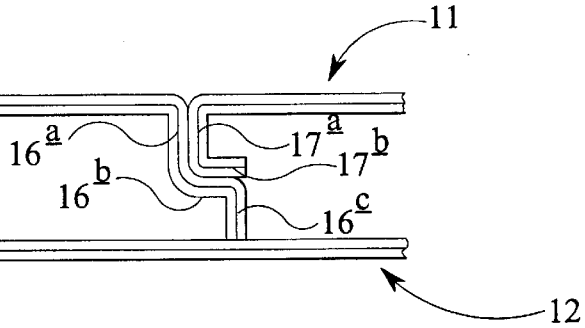
Figure 7:
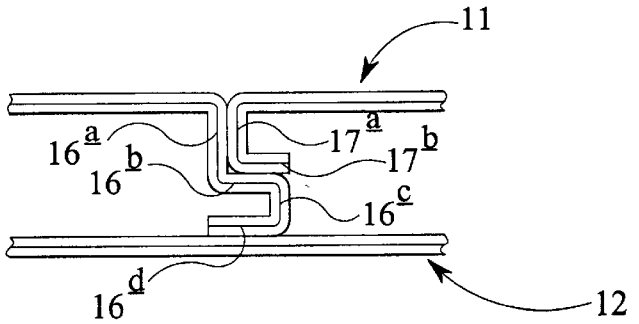

In the modifications of FIG. 2 illustrated in FIGS. 6 and 7 the second region 1*b* of the partition wall 16 extends generally parallel to the upper and lower walls 11, 12 of the tube and thus lies generally at right it angles to the parallel first and third regions 16*a*, 16*c* of the partition wall 16. The tamed in portion of the right-hand lateral edge region of the strip includes a first region 17*a* abutting, in facial contact with, the partition wall first region 16*a*, and an integral second region 17*b* bent at right angles to the fist region 17*a* and abutting, in facial contact with, the partition wall second region 16*b*. In addition in the example illustrated in FIG. 7 the partition wall 16 includes a fourth region 16*d* bent at right angles to the third region 16*c* and abutting, in facial contact with, the inner surface of the wall 12 of the tube. As with the foregoing examples it can be seen that the partition wall 16 of the tubes of FIGS. 6 and 7 are shaped to define a recess receiving the Portion 17 of the tube. The efficiency of mechanical "locking" of the portion 17 in the recess is high given the right angle orientation of the "knee" and the designs are strong in compression, and exhibit minimal gap at the interface of the regions 16*a* and 17*a*.

It will be recognised that tubing formed in the manner described above can be used in environments other than automobile heat exchangers. Moreover, although the formation is particularly advantageous where the material is an aluminium strip clad with a brazing alloy, similar forms could be produced from other strip materials including aluminium strip clad on one side with a "brazing" alloy and clad on its opposite side with an erosion and/or corrosion resistant layer.

It is to be recognised that the invention in this application also resides in a method of manufacturing a flat tube from strip material by using a cold-rolling process to convert the strip into a closed tabular form having upper and lower parallel walls and an internal partition wall having a "knee" or recess therein receiving an edge portion of the opposite lateral edge region of the strip. The invention also resides in a method of manufacturing a heat exchanger utilising such tubes in which the assembled heat exchanger is subjected to a heating process to fuse brazing alloy provided as a cladding on the strip material from which the tubes are manufactured.

What I claim is:

1. A flat, heat exchanger tube formed by rolling metal strip having a coating of a cladding layer on one face thereof to fold inwardly opposite lateral edge regions of the strip to provide a tube having said coating on its exterior face, and further having parallel, spaced, generally planar first and second walls, one of said lateral edge regions of the strip being bent to define a longitudinally extending partition wall extending within the tube from said first wall to said second wall, said partition wall including a first region which extends inwardly of the tube from said first wall generally at right angles to said first wall, a second region integral with first region, commencing at an inner edge of the first region of said partition wall and extending at an angle to said first region to define therewith a shoulder within the confines of the tube, and, a third region integral with said second region and commencing at an edge of the second region remote from the first region, said third region extending from said second region to an inner face of said second wall of the tube and bent adjacent its edge remote from said second region to define a flange in contact with the inner surface of said second wall, said third region of said partition wall lying parallel to said first region but in a plane spaced from the plane of the first region of the partition wall, the other of said lateral edge regions of said strip being bent to have a portion extending inwardly of the formed tube from said first wall towards said second wall, with the face of said portion having said coating in facial contact with the face of said first region of said partition wall having said coating and a free edge of said portion of the other of said lateral edge regions of the strip being presented to said shoulder of said partition wall, said flange extending longitudinally of the partition wall and having the face thereof carrying said coating in facial contact with said inner face of said second wall.

2. A heat exchanger as claimed in claim 1 wherein said angle between said first and second regions of said partition wall is a right angle.

3. A heat exchanger as claimed in claim 1 wherein said angle between said first and second regions of said partition wall is an oblique angle.

4. A flat, heat exchanger as claimed in claim 1 wherein said flange of said partition wall is defined by an integral fourth portion of the partition wall extending at right angles to said third portion of the partition wall in a direction towards the plane of the first portion of the partition wall and making facial contact between the coated surface of the fourth portion of the partition wall and the inner surface of the second wall of the tube.

5. A heat exchanger as claimed in claim 2 wherein said inwardly extending portion of said other lateral edge region of the strip is bent at right angles at its inner edge to define a longitudinally extending region making facial contact with said shoulder of said partition wall.

6. A flat, heat exchanger tube as claimed in claim 1 wherein the angle and extent of said second region of the partition wall, relative to said first and third regions, is such that said third region plane is spaced from said first region plane by the thickness of the strip material.

7. A flat, heat exchanger tube as claimed in claim 1 wherein, said flange of the partition wall is defined by a fourth region commencing at the edge of the third region remote from the second region, said fourth region being a region of the strip bent through 180°, and thus lying in facial contact with the face of the partition wall remote from the face of the partition wall engaged by said free edge portion of said other of said lateral edge regions of the strip.

* * * * *